US005301614A

United States Patent [19]

Rieger

[11] Patent Number: 5,301,614

[45] Date of Patent: Apr. 12, 1994

[54] SUBMUNITION FOR USE DURING GROUND-LEVEL FLIGHT

[75] Inventor: Ulrich Rieger, Feldkirchen-Westerham, Fed. Rep. of Germany

[73] Assignee: Messerschmitt-Boelkow-Blohm AG, Fed. Rep. of Germany

[21] Appl. No.: 953,266

[22] Filed: Sep. 30, 1992

[30] Foreign Application Priority Data

Oct. 9, 1991 [DE] Fed. Rep. of Germany ..... 4133405

[51] Int. Cl.[5] ..... F42B 10/02; F42B 10/32; F42B 12/58

[52] U.S. Cl. ..... 102/384; 102/393; 102/489; 244/3.21

[58] Field of Search ..... 102/384, 393, 396, 397, 102/386, 489; 244/3.21

[56] References Cited

U.S. PATENT DOCUMENTS 3,964,694 6/1976 Metzger et al. ..... 244/3.21
4,143,836 3/1979 Rieger ..... 102/384
4,172,407 10/1979 Wentink ..... 102/489
4,262,596 4/1981 Allier et al. ..... 102/476
4,417,520 11/1983 Maudal ..... 102/384
4,522,356 6/1985 Lair et al. ..... 102/489
4,711,412 12/1987 Wallermann ..... 244/3.21

FOREIGN PATENT DOCUMENTS 3323685 1/1985 Fed. Rep. of Germany .

OTHER PUBLICATIONS

"Intelligente Munition fur Rohr und Rakete", Borchet, pp. 690–699 Soldst und Technik Oct. 1991.

*Primary Examiner*—David H. Brown
*Attorney, Agent, or Firm*—Evenson, McKeown, Edwards & Lenahan

[57] ABSTRACT

Submunition is transported by a carrier to a target area and launched there, whereupon it covers a preset distance at a constant altitude at an angle to the flight axis of the carrier. The submunition has a target sensor and a payload, and is equipped with an altimeter as well as a circuit to evaluate the altimeter readings, and with at least one altitude/roll rudder controllable by this circuit.

19 Claims, 4 Drawing Sheets

SUBMUNITION FOR USE DURING GROUND-LEVEL FLIGHT

BACKGROUND AND SUMMARY OF THE INVENTION

The present invention relates to submunition, especially for use during ground-level flight, transportable by a carrier to a target area and launchable there. The submunition covers a given path at a constant low altitude with controlled roll, said path lying at an angle to the flight axis of the carrier, said submunition having a target sensor and a payload.

Current possibilities for combatting groups of armored vehicles, especially tanks, at long range, are unsatisfactory. Thus, for deliberately combatting each individual target, in other words each tank, it is necessary to resort either to guided missiles, bombs, or guns, said methods requiring a considerable amount of mission time; or the area in which the vehicle group is located must be bombarded with statistically effective munitions, requiring a high weapon weight. Both types of attack also result in serious commitment and risk to the weapons carriers involved.

To overcome these disadvantages, target-seeking munitions and/or submunitions have already been developed. A type of submunition provided with a target-seeking fuse, during braked steep descent, scans the ground for target criteria in a narrowing spiral strip. When a target is detected, either a projectile-forming charge is fired at the target (target-seeking fuse submunition) or the submunition itself is steared to the target. In this solution, the submunition must be lifted to a high launching altitude, which in the case of air-to-ground weapons either means launching at this altitude and hence a considerable risk to the carrier, or in the case of launching at ground level, results in a high cost for elevating the submunition plus corresponding width distribution.

Another possibility consists in designing the submunition as a guided missile with a forward-looking target-seeking head. In this case, although the submunition heads for the target automatically after acquiring it, this type of guided missile design is very cumbersome and hence very expensive.

Hence, both solutions require long target acquisition distances as well as high sensitivity to other factors besides the targets to be attacked, giving these targets the opportunity to take countermeasures; the risk of attacking multiple targets cannot be ruled out either.

German Patent No. 3,345,601 teaches a submunition body which can be fired by an artillery weapon and can be launched by the latter over a target area while executing a turn; the submunition body is equipped with a target-acquisition sensor and a warhead in a hollow cylinder. Thus, with this known submunition body, there is no need for design-intensive measures that take up room and are functionally critical, to nullify kinetic energy following launching and parachute-braked descent into the target area, using the gyroscopic movement of a body designed as a thick disk, for example a flat cylinder, launched from the carrier projectile, to scan the target area using a target acquisition sensing spot. An arrangement of this kind is unsuitable for launching at high airspeeds, since it is only at very high natural rotational speeds that the body can be sufficiently stable, but this cannot as yet be controlled technologically for scanning and target accuracy. On the other hand, the target area that can be scanned, for example the area covered by spiral movement during ground-level flight, is very limited, and also because the unavoidable wobbling motion permits only a very short free-flight distance.

Effective attack against tank groups is only possible by launching this submunition from a high altitude, i.e. taking defensive measures into account.

The goal of the present invention is to provide submunition for attacking hardened mobile group targets, said submunition being launchable during ground-level flight and highly effective against modern tanks, ensuring independent target acquisition over large search areas and offering a low risk of multiple target attack at moderate cost.

Beginning with a submunition of the type described in greater detail above, it is proposed to achieve this goal by providing the submunition with an altimeter as well as a circuit to evaluate the altimeter readings, and with at least one airfoil controllable by this circuit and serving to control altitude and roll.

The submunition is launched from a carrier in flight and, guided by the altimeter, follows a low-altitude flight path parallel to the terrain. For high-speed ground-level applications, the submunition requires no drive because of its high kinetic energy, but may be equipped with one. During free flight at approximately constant low altitude, the submunition uses its target acquisition sensor to seek targets continuously in a strip beneath it. When a target is acquired, it directs an effect-oriented charge at the target and releases it.

The altimeter is advantageously a laser rangefinder which can simultaneously serve as the target contour acquisition sensor. To acquire the target, additional sensors can be used either as backups or as alternatives.

In a preferred embodiment, the submunition is equipped with a laser rangefinder for altitude and target measurement, and with a magnetic field sensor as a second target sensor, said rangefinder and sensor being connected to the payload ignition triggering circuit.

In this preferred embodiment, the laser sensor and payload are installed rigidly, axially parallel and at right angles to the direction of flight. To scan the search strip and measure the altitude, the submunition continuously performs an oscillating rolling motion.

In a second preferred embodiment, the target acquisition sensor and payload have certain width effects tuned to one another, i.e., they are offset with respect to the submunition's longitudinal axis. Once again, both are rigidly installed, axially parallel, and at right angles to the flight direction. In this case, the submunition flies without any rolling motion as it seeks the target.

The submunition according to the invention, especially suitable for use in high-speed ground-level flight, offers a favorable compromise between weapon cost and required transportation expense. Because of the short distance to the target (on the order of 20 to 50 m), the requirements for sensory devices, signal processing, and tolerances can be kept low. The short distance to the target also offers favorable target acquisition opportunities, since only minor target concealment by environmental factors can be expected and sensitivity to weather and defensive measures is low.

The submunition according to the invention, because of its gliding flight, covers a relatively wide strip of land measuring a few thousand square meters. With a suitable launching sequence from the carrier, the overlap of the search strips of several submunition bodies can be minimized. This provides a high degree of efficiency as a function of weapon weight and total target area, in other words a high probability of acquisition of all individual targets and a low probability of a double attack on mobile targets.

As a result of the long range of the submunition, especially at high transverse launch velocities, broad target areas can be covered. This makes this weapon, in conjunction with an adjustable launch sequence, insensitive to the direction of attack and target geometry; in other words, it offers greater operational flexibility.

Suitably adapted software allows the submunition according to the invention to be used to attack other groups of mobile targets or vehicles that are only roughly recognized by their positions, such as rocket positions, helicopter bases, motorized armored companies, artillery positions, command posts, etc. The flight path can also be curved horizontally either by structural design or optionally by suitable roll control.

Other objects, advantages and novel features of the present invention will become apparent from the following detailed description of the invention when considered in conjunction with the accompanying drawings.

DETAILED DESCRIPTION OF THE DRAWINGS

Figure 1A:
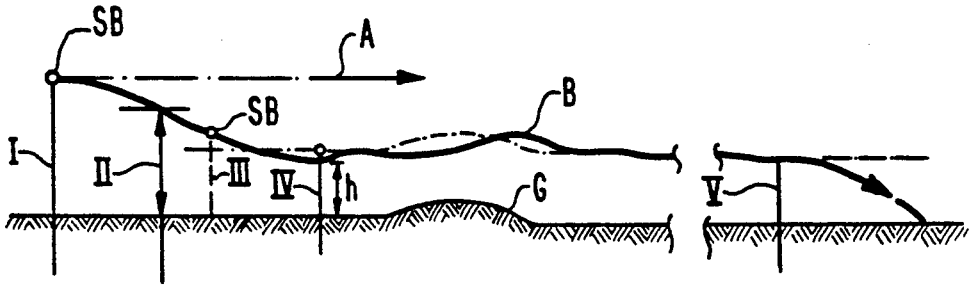
FIG. 1*a* is a side view of one contemplated flight path of a submunition according to a preferred embodiment of the invention.
Figure 1B:
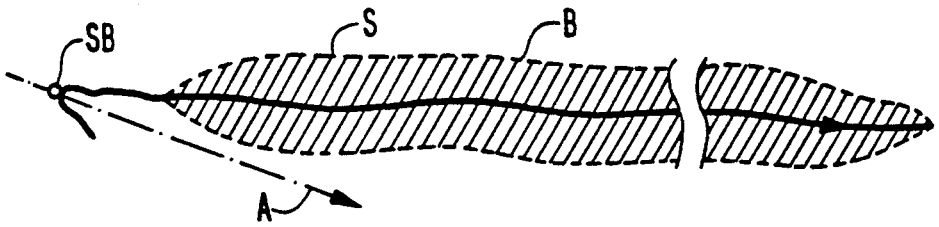
FIG. 1*b* is a top view of this flight path of FIG. 1*a;*
Figure 1C:
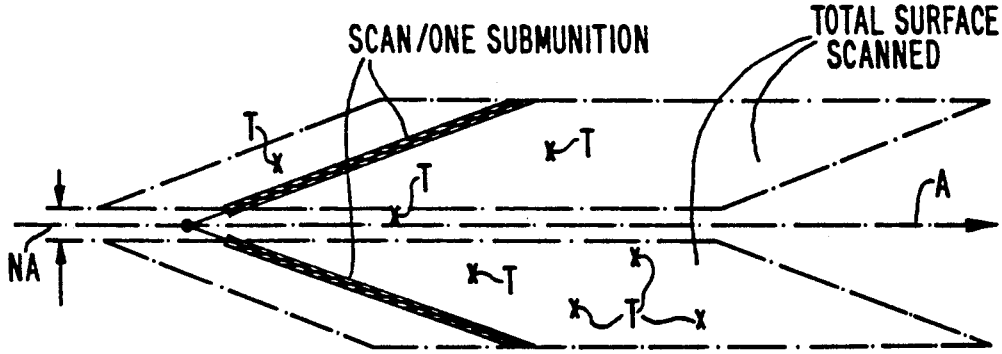
FIG. 1*c* depicts the ground area covered by the submunition bodies.

FIG. 1, the arrow A pointing to the right marks a submunition carrier 10 path taken by a carrier launching one or more submunition bodies SB at launch position I. After a submunition SB is launched, it switches to gliding flight and maintains its specified altitude h, 20 m for example, and maintains this altitude h using its altitude maintenance device until the flying speed falls below the minimum value. The flight path over the ground G is not guided and runs essentially in a straight line at an angle to the carrier path, depending on the launch conditions (FIG. 1*c*). At the same time, the submunition body SB controls its rolling position so that its target acquisition sensor can scan the ground G. The submunition SB glides downwardly from launch position I to position II, which is its maximum altitude for starting its height sensing and control, then to position III which is a first height, and then to position IV which is at its predetermined height h, which is maintained until position V at which minimum flight speed is reached.

During the gliding flight of the submunition body 2, the target acquisition device is continuously pivoted essentially perpendicularly to the flight axis and therefore searches a strip S below the submunition SB (FIG. 1*b*) for targets T. Alternatively, the target acquisition device has a broad acquisition window. When a target T is acquired, the payload is released, directed at the target T parallel to the axis of the target acquisition device.

Figure 5:
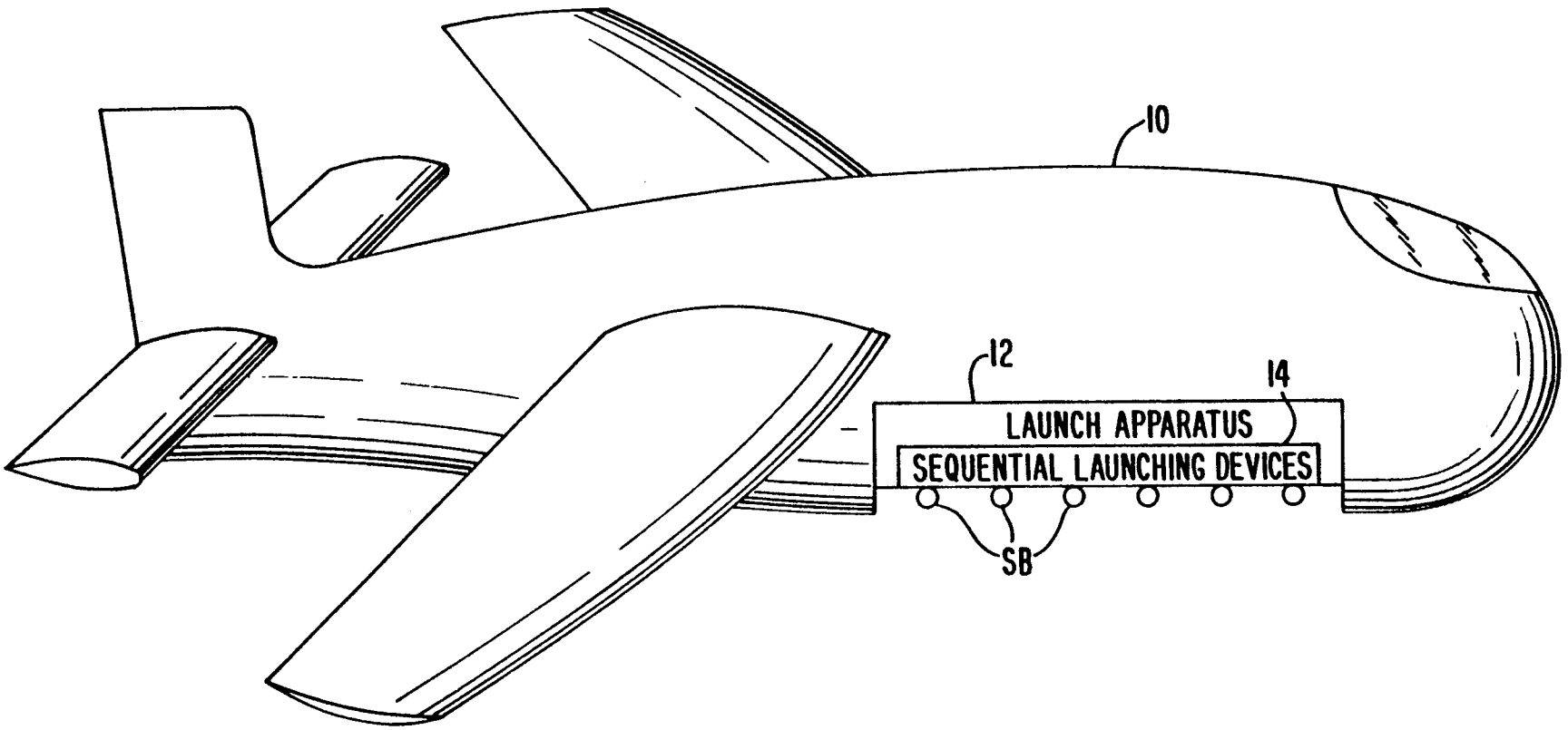
FIG. 5 is a schematic diagram of an airplane carrier having a launch apparatus with sequential launching devices for a plurality of submunitions.

The carrier 10 can contain a large number of submunition bodies SB (FIG. 5) that are launched by launch apparatus 12 in a fixed sequence by sequential launched devices 14 or in a sequence adapted to the target geometry so that the search strips of the individual submunition bodies SB adjoin one another. In this way, as shown in FIG. 1*c*, the entire target area is searched for targets T. In the simplest case, a narrow alley NA beneath the carrier path A remains unscanned; its width depends on the launch altitude and is due to the fact that the submunition bodies SB are not activated until a certain time has elapsed following their launch from the carrier before they can scan the target area beneath them for targets T.

Figure 2:
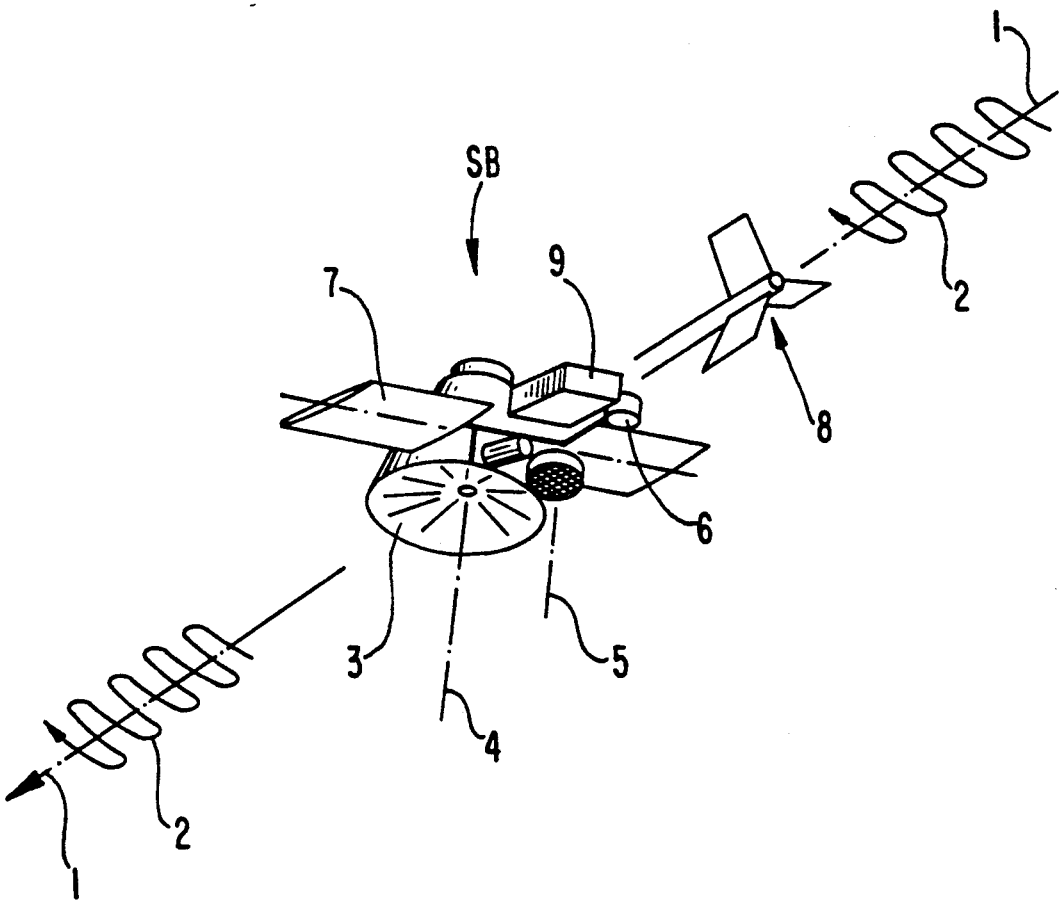
FIG. 2 is a schematic diagram of a submunition constructed according to a preferred embodiment of the invention.

FIG. 2 shows the schematic design of a submunition SB according to a preferred embodiment of the invention, where 1 is the main axis in the direction of flight, 2 represents meander-shaped arrows intended to indicate oscillation around main axis 1, 3 is a payload, for example a projectile-forming hollow charge with a suitable safety device, 4 is the axis of the hollow charge, 5 is an altitude and target sensor, 6 is a second target sensor, 7 is a pair of adjustable airfoils used for altitude and roll control, 8 is a rigid control surface for aerodynamic stabilization, and 9 is a power source as well as a signal-processing circuit for both the target acquisition equipment and for controlling roll and altitude.

A laser rangefinder is especially suitable as an altimeter, and can be made not only for information about altitude but also for target acquisition by measuring the characteristic target contours. In addition, a second target sensor, for example a magnetic sensor, is provided to supply a second target determination criterion. The laser sensor is located so that its sensing direction runs essentially perpendicular to main axis 1 of the submunition. The adjustable aerodynamic surfaces, i.e. wings or airfoils 7, serve to maintain an essentially constant altitude and to keep the target-measuring laser sensor with its acquisition direction toward the ground.

The submunition is launched for example at high transverse velocity from a carrier in high-speed ground-level flight at a speed of Mach 0.8 at an altitude of 40 m for example. It unfolds into the free-flight configuration, stabilizes its main axis in the flight direction, and begins executing rapid oscillating movements with the aid of its rudders 7. Laser rangefinder 6, beginning with its maximum acquisition range, determines the shortest echo distance for each oscillation of the submunition. This is interpreted as the vertical altitude, so that depending on the distance, the control element for airfoil 7 is actuated in such fashion that the preset altitude h of 20 m for example is maintained. The submunition glides above the ground at this altitude h (FIG. 1*a*). In addition, the airfoils, by superimposing a roll command on oscillation and altitude maintenance, are deflected so that the vertical height corresponds to the center of the oscillating movement.

In flight, the second target sensor, a magnetic sensor for example, searches using target criteria. If this magnetic sensor responds when tanks are present, the signal from the altimeter, i.e. the laser rangefinder, is evaluated for changes in height profile for example that are characteristic of large vehicles. Such a height discontinuity combined with a simultaneous positive target report from the second sensor is interpreted as a target and the projectile-forming charge is triggered. Because of its axially parallel position relative to the laser, the payload is fired in the direction of the target as indicated by contour evaluation.

Figure 3A:
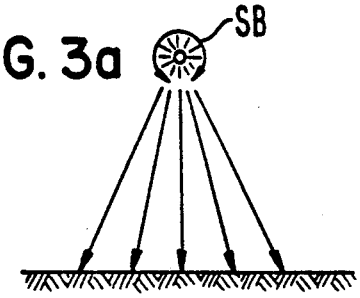
FIGS. 3*a* to 3*d* are schematic views which show planes perpendicular to the flight path, before and during the attack on the target of the submunition of FIGS. 1*a*–2.

FIGS. 3*a* to *d*, in planes perpendicular to the flight path, show sections through the submunition SB. FIG. 3*a* shows the shortest range, interpreted as vertical altitude h, at which the submunition travels during its target seeking phase of operation.

Figure 3B:
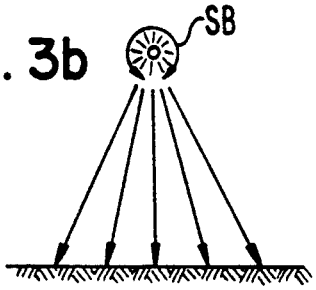

FIG. 3*b* depicts a submunition flight phase when first detecting a magnetic field MF and setting of a prealarm.

Figure 3C:
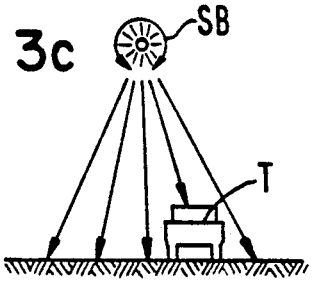
Figure 3D:
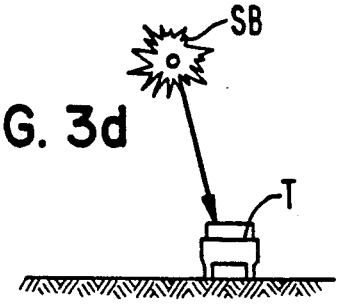
Figure 4A:
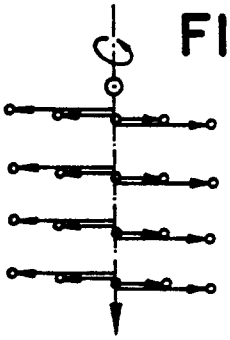
FIGS. 4*a* to 4*d* are schematic top views of these flight paths of FIGS. 3*a* to 3*d;*
Figure 4B:
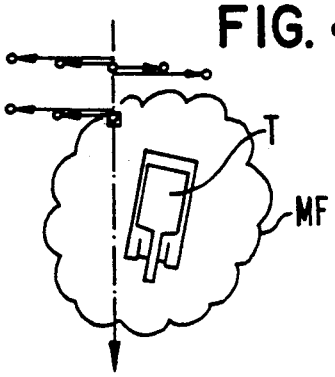
Figure 4C:
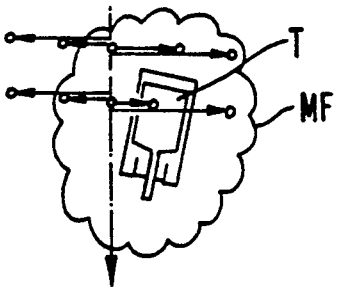
Figure 4D:
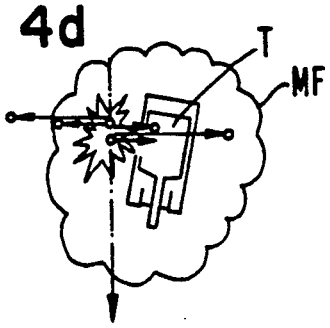

FIG. 3*c* shows that a target T has been detected and FIG. 3*d* shows the attack on this target T in schematic form.

FIGS. 4*a* to *d* show these same phases (FIGS. 3*a* to 3*d* respectively) of attacking the target T in a top view.

By choosing the appropriate configuration for the submunition SB shown in FIG. 2, the ignition time can be chosen for maximum effect, for example for an impact angle which is as steep as possible or for an attack against high horizontal surfaces, the tops of the tanks for example.

Control circuit 9 can operate with a time delay relative to the time taken to travel the minimum distance so that depending on the setting, flight paths that curve to the right or the left over the ground can be produced. This permits course changes for example for submunition bodies launched simultaneously or in the same direction, in other words less double coverage of a strip of land or even reduction or elimination of strips that are not covered, for example the narrow alleys NA below the carriers (FIG. 1*c*).

The adjustment of the courses to be maintained by the submunition bodies can be determined by the carrier. In the simplest case, despite using submunition of similar design, optimum area coverage can be achieved by adjusting the areas of the relative positions of the carrier to the target and the target geometry.

The submunition according to the invention permits high attack probability even against widely separated tanks from ground level flight, with effective utilization of weapon weight and moderate cost.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Submunition transportable by means of a carrier to a target area and launchable there on a given course relative to the carrier direction, said submunition comprising:

a target sensor, a payload, an altimeter and a circuit to evaluate the altimeter readings, at least one adjustable airfoil; and means for controlling the at least one adjustable airfoil, responsive to the circuit, such that the submunition maintains a constant low altitude above ground level for a finite glide in a rolling position sequence on the given course under kinetic energy provided during the launch.

2. Submunition according to claim 1, further comprising means for effecting the desired rolling position that is periodic oscillation around the lengthwise axis.

3. Submunition according to claim 1, wherein said control means further controls the adjustable rudder such that the submunition performs the finite glide in a horizontally curved direction.

4. Submunition according to claim 1, wherein the altimeter is a laser rangefinder, and wherein the target sensor is a magnetic field sensor whose measurement directions run mainly perpendicular to the lengthwise axis of the submunition.

5. Submunition according to claim 4, wherein the payload is a projectile-forming hollow charge, whose hollow charge spine is made essentially perpendicular to the lengthwise axis of the submunition and which, viewed in the circumferential direction of the submunition, is offset with respect to the target sensor in such fashion that the time that elapses between target acquisition, target calculation, and ignition is compensated.

6. Submunition according to claim 1, wherein the target sensor is an acoustic sensor.

7. Submunition according to claim 6, wherein the payload is a projectile-forming hollow charge, whose hollow charge spine is made essentially perpendicular to the lengthwise axis of the submunition and which, viewed in the circumferential direction of the submunition, is offset with respect to the target sensor in such fashion that the time that elapses between target acquisition, target calculation, and ignition is compensated.

8. Submunition according to claim 1, wherein the altimeter is a rangefinder which also serves as target sensor.

9. Submunition according to claim 8, wherein the payload is a projectile-forming hollow charge, whose hollow charge spine is made essentially perpendicular to the lengthwise axis of the submunition and which, viewed in the circumferential direction of the submunition, is offset with respect to the target sensor in such fashion that the time that elapses between target acquisition, target calculation, and ignition is compensated.

10. Submunition according to claim 1, wherein the payload is a projectile-forming hollow charge, whose hollow charge spine is made essentially perpendicular to the lengthwise axis of the submunition and which, viewed in the circumferential direction of the submunition, is offset with respect to the target sensor in such fashion that the time that elapses between target acquisition, target calculation, and ignition is compensated.

11. Submunition according to claim 10, further comprising means for effecting the desired rolling position that is periodic oscillation around the lengthwise axis.

12. Weapon system comprising:

a carrier capable of low altitude flight along a predetermined carrier flight path, at least one submunition carried by the carrier, and launching apparatus for launching the submunition from the carrier in a given direction corresponding to the carrier flight path, wherein said submunition includes:

a target sensor, a payload, an altimeter and a circuit to evaluate the altimeter readings, at least one adjustable airfoil; and means for controlling the at least one adjustable airfoil, responsive to the circuit, such that the submunition maintains a constant low altitude above ground level for a finite glide in a rolling position sequence on the given direction under kinetic energy provided during the launch.

13. Weapon system according to claim 12, wherein a plurality of submunitions are carried by the carrier, and wherein said launching apparatus includes devices for sequentially launching the submunitions one behind the other so that the target sensors of multiple submunitions scan overlapping ground surface target areas during flight of the submunition at the set altitude.

14. Weapon system according to claim 12, wherein the altimeter is a laser rangefinder, and wherein the target sensor is a magnetic field sensor whose measurement directions run mainly perpendicular to the lengthwise axis of the submunition.

15. Weapon system according to claim 12, wherein the target sensor is an acoustic sensor.

16. Weapon system according to claim 12, wherein the altimeter is a rangefinder which also serves as target sensor.

17. Weapon system according to claim 12, wherein the payload is a projectile-forming hollow charge, whose hollow charge spine is made essentially perpendicular to the lengthwise axis of the submunition and which, viewed in the circumferential direction of the submunition, is offset with respect to the target sensor in such fashion that the time that elapses between target acquisition, target calculation, and ignition is compensated.

18. Weapon system according to claim 12, further comprising means for effecting the desired rolling position that is periodic oscillation around the lengthwise axis.

19. Weapon system according to claim 13, wherein the carrier is an airplane.

* * * * *